US007469446B1

(12) United States Patent
Brown et al.

(10) Patent No.: US 7,469,446 B1
(45) Date of Patent: Dec. 30, 2008

(54) INTEGRATED HINGE AND TEMPORARY DOOR CHECKER

(75) Inventors: Mark E. Brown, Bellefountain, OH (US); Marc D. Iman, Plain City, OH (US); Shawn Sullivan, Marysville, OH (US); Cindy Tran, Plain City, OH (US)

(73) Assignee: Honda Motor Co., Ltd., Tokyo (JP)

( * ) Notice: Subject to any disclaimer, the term of this patent is extended or adjusted under 35 U.S.C. 154(b) by 274 days.

(21) Appl. No.: 10/878,897

(22) Filed: Jun. 28, 2004

(51) Int. Cl.
*E05F 5/02* (2006.01)
*E05D 11/10* (2006.01)

(52) U.S. Cl. ..... 16/334; 16/335; 16/82

(58) Field of Classification Search ..... 16/333–335, 16/343, 344, 347, 386, 82, 85; 296/146.11, 296/146.12
See application file for complete search history.

(56) References Cited

U.S. PATENT DOCUMENTS

| | | | | | |
|---|---|---|---|---|---|
| 3,889,316 | A * | 6/1975 | Koike | 16/297 |
| 4,532,675 | A * | 8/1985 | Salazar | 16/335 |
| 4,794,669 | A * | 1/1989 | Sanders | 16/341 |
| 4,800,624 | A * | 1/1989 | Whitefoot et al. | 16/332 |
| 5,018,243 | A * | 5/1991 | Anspaugh et al. | 16/335 |
| 5,323,512 | A * | 6/1994 | Little | 16/332 |
| 5,509,175 | A * | 4/1996 | Baughan et al. | 16/332 |
| 5,577,295 | A * | 11/1996 | Papke et al. | 16/254 |
| 5,918,347 | A * | 7/1999 | Morawetz | 16/322 |
| 5,924,170 | A | 7/1999 | Papke et al. | |
| 6,332,243 | B1 | 12/2001 | Kim | |
| 6,334,236 | B1 | 1/2002 | Kalliomaki | |
| 6,438,794 | B2 | 8/2002 | Ng et al. | |
| 6,467,126 | B1 * | 10/2002 | Yezersky et al. | 16/86 C |
| 6,481,056 | B1 | 11/2002 | Jesse | |
| 6,581,243 | B2 * | 6/2003 | Parizel | 16/334 |
| 6,591,451 | B2 | 7/2003 | Gruber et al. | |
| 6,739,020 | B1 * | 5/2004 | Morawetz | 16/334 |
| 6,901,634 | B2 * | 6/2005 | Shaw et al. | 16/344 |
| 2001/0022011 | A1 * | 9/2001 | Vittorio | 16/334 |
| 2003/0140455 | A1 * | 7/2003 | Audisio | 16/334 |

FOREIGN PATENT DOCUMENTS

| | | | |
|---|---|---|---|
| JP | 2001220939 A | * | 8/2001 |
| WO | WO 99/42689 | * | 8/1999 |

* cited by examiner

*Primary Examiner*—Chuck Y. Mah
(74) *Attorney, Agent, or Firm*—Rankin, Hill & Clark LLP; Vincent Ciamacco

(57) ABSTRACT

An integrated hinge system that provides for temporary checking of a vehicle door is provided, the system including a hinge pin, a door hinge bracket, a pillar hinge bracket, and a latching device. The latching device is releasably affixed to the door hinge bracket and rotates with the door hinge bracket relative to the hinge pin and the pillar bracket. One of the hinge pin and the pillar bracket define engagement points that the latching device engages to releasably retain the door hinge bracket in any one of at least two angular orientations relative to the pillar hinge bracket.

13 Claims, 9 Drawing Sheets

12
60a
18b
18c
68a
68b
16a
14
54a
34
51

24
18c
60a
34
16b
36
18a
60b
26
18b
16c
16a
42
54a
54b 12
70a
68a
69a
68b
70b
24
34
69b
60a
16a 18
18c
18a
18b
16a
18a
16b
42
16c
26
24
18b
60a
60b
51
59

12
14
60a
16a
118b
78b
79b
79a
34
54a
51

24
118c
60a
34
166
36
60b
26
16a
118b
118
118a
42
16c
54a
54b 118
118c
118b
118a 12
24
16a
34
118b
78a
60a
78b
79b
79a
168b
168a 16a
118b
24
118c
118a
16b
42
16c
26
6oa
59
51
60b 12
24
60a
318c
318b
34
14
54a
51
16a 24
318c
60a
34
166
36
26
318a
318b
16a
16a
42
54a
54b
51

318
318a
318b
318c 278a
318c
318b
60a
34
368b
16a
368a
278b 318a
24
318b
16a
60a
166
60b
16c
26
42
59
51

14
54a
51
378b
24
60a
12
16a
418b
378a
418c
34

378b
16a
60a
34
418c
468b
378a
468a 24
60a
34
166
418b
36
60b
26
16a
16c
42
418a
54a
54b
51

418
418b
418c
418a 24
16a
60a
16b
418b
16c
26
418c
60a
51
59
42
60b

INTEGRATED HINGE AND TEMPORARY DOOR CHECKER

CROSS REFERENCE TO RELATED APPLICATION

The disclosure of U.S. patent application Ser. No. 10/878,761, filed Jun. 28, 2004, is expressly incorporated herein by reference in its entirety.

BACKGROUND OF THE INVENTION

During the manufacture and assembly of vehicles, it is often necessary to perform certain operations with the vehicle body and doors assembled. Automated application of sealer to body joints and door joints and painting of the vehicle are examples of such operations. Concurrent door and body painting provides uniform color and quality between the body and doors. During the sealing and painting operations, the vehicle door must be opened and closed numerous times. Because the painting, etc. is often performed by automated systems, position and repeatability of locating the doors is of primary importance.

Door hinges used on the finished vehicle may also be used during these intermediate assembly steps such as painting. However, the permanent door checking devices used on the finished vehicle typically are not in place during these intermediate steps because they can be damaged by the harsh environment in paint operations (ovens, paint, use of electrostatic equipment, solvents, and/or preparatory cleaners). As a substitute, temporary door checking devices are used to hold doors in desired positions during these intermediate steps. Typically, a temporary checking device is affixed to the door and vehicle body before the operation begins and removed after the operation is complete and often reused. The temporary checking device may be positioned at the same location in which the permanent door checking device used on the finished vehicle will be placed.

Because most temporary checking devices are self contained, requiring nothing except a place to be mounted, they tend to be relatively complex and time consuming to install and remove. This increases overall vehicle manufacturing costs. What is desired is a temporary checking device that works in conjunction with elements already in place on the vehicle, the temporary checking device being simple and easily installed and removed.

BRIEF SUMMARY OF THE INVENTION

The present invention provides an improvement over the prior art by providing a temporary checking device that works in conjunction with elements of a vehicle hinge that will remain in the vehicle's final configuration. Moreover, the checking device is simpler and more easily installed and removed than the door checkers known in the art.

In accordance with the present invention, a hinge system is provided that includes a hinge pin, a door hinge bracket receiving the hinge pin, a pillar hinge bracket also receiving the hinge pin, and a latching device secured to one of the door hinge bracket and operable to selectively engage any one of a plurality of engagement points. The door hinge bracket is rotatably movable with respect to the pillar hinge bracket. The latching device, which is releasably affixed to the door hinge bracket and moves therewith, includes a head selectively engageable with the engagement points during movement of the door hinge bracket relative to the pillar hinge bracket and the hinge pin. Interaction between the latching device and the engagement points provides locations in which the door hinge bracket, and thus the door secured thereto, may be temporarily checked or stopped with respect to the pillar hinge bracket (i.e., the vehicle body) so that the door may be releasably maintained in a desired angular orientation (degree of opening).

In accordance with one aspect of the invention, the engagement points are provided on a head of the hinge pin. In accordance with another aspect of the invention, the engagement points are provided on the pillar hinge bracket.

BRIEF DESCRIPTION OF THE FIGURES

These and further features of the invention will be apparent with reference to the following description and drawings, wherein.

DETAILED DESCRIPTION OF THE PREFERRED EMBODIMENTS

Figure 1A:
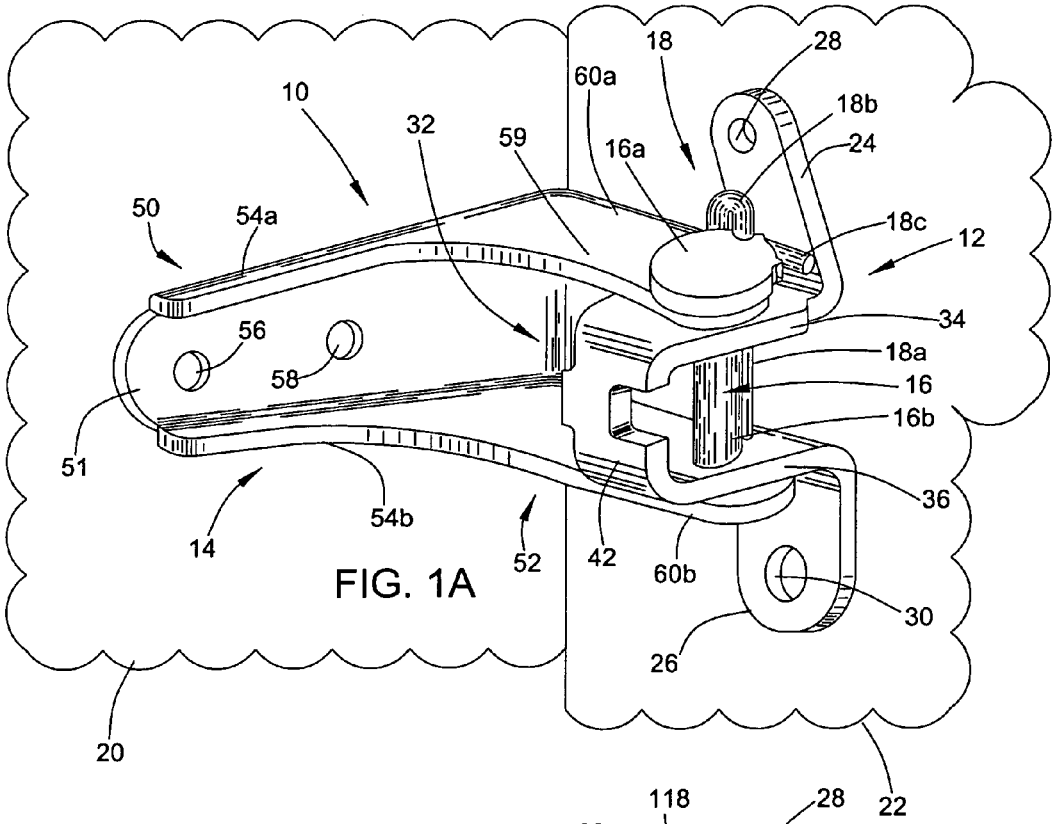
FIG. 1A is a perspective view of a hinge system according to a first embodiment of the present invention.
Figure 2A:
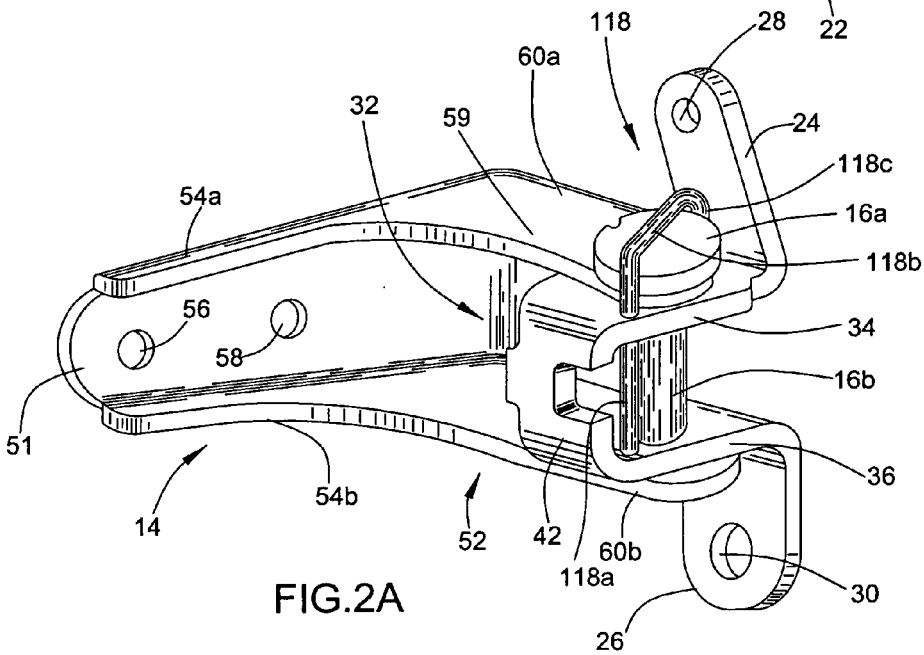
FIG. 2A is a perspective view of a hinge system according to a second embodiment of the present invention.

With reference to FIG. 1A, the hinge system 10 of the present invention includes a door hinge bracket 12, pillar hinge bracket 14, a hinge pin 16, and a latching device 18. Although only illustrated in a cursory fashion in FIG. 1A, it is considered apparent that the pillar hinge bracket 14 is adapted to be affixed to a vehicle pillar 20, and the door hinge bracket 12 is adapted to be affixed to a vehicle door 22.

The door hinge bracket 12 is rotatably secured to the pillar hinge bracket 14 via the hinge pin 16 and the angular orientation of the door hinge bracket and the door secured thereto may be checked or releasably maintained in any one of two or more positions via interaction of the latching device 18 and one of a plurality of engagement points, as described hereinafter.

The door hinge bracket 12 is affixable to the vehicle door 22 and includes a first or upper ear 24 extending vertically upward and a second or lower ear 26 extending vertically downward. Each ear 24, 26 defines a hole 28 and 30 for the passage of a fastener to affix the door hinge bracket 12 to the vehicle door 22. Integrally formed with the first and second ears 24, 26 and extending therebetween is a U-shaped intermediate member 32.

The U-shaped intermediate member 32 has an upper leg 34, a lower leg 36, and a base 42 interconnecting the upper and lower legs 34, 36. The upper leg 34 extends between and interconnects the upper ear 24 and the base 42. The lower leg 36 extends between and interconnects the lower ear 26 and the base 42. Each leg 34 and 36 of the U-shaped member defines a hole through which the hinge pin 16 extends.

The pillar hinge bracket 14 is generally L-shaped and includes a pillar flange 50 and a pin bracket 52. The pillar flange 50 has a generally planar base wall 51 from which upper and lower raised peripheral walls 54*a*, 54*b* extend. The pillar flange 50 defines two holes 56 and 58 for the passage of fasteners that affix the pillar hinge bracket 14 to the vehicle pillar 20.

The pin bracket 52 is oriented generally perpendicular to the pillar flange 50 and includes a base wall 59 and upper and lower raised peripheral walls 60*a*, 60*b*. The base wall 59 of the pin bracket 52 integrally extends from the base wall 51 of the pillar flange 50. The upper and lower raised peripheral walls 60*a*, 60*b* of the pin bracket 52 integrally merge with the upper and lower raised peripheral walls 54*a*, 54*b*, respectively, of the pillar flange 50, as illustrated. Preferably, the pin bracket base wall 59 is shorter in length than the pin bracket peripheral walls 60*a*, 60*b* such that the pin bracket peripheral walls 60*a*, 60*b* extend past the end of the pin bracket base wall 59, as illustrated.

Each of the upper and lower pin bracket peripheral walls 60*a*, 60*b* define a hole near their distal ends. When the hinge system 10 is assembled, the holes defined by the pin bracket peripheral walls 60*a*, 60*b* align with the holes formed in the upper and lower legs 34, 36 of the U-shaped member 32 of the door hinge bracket 12 and cooperate to receive the hinge pin 16.

The hinge pin 16 includes an enlarged upper head 16*a*, a cylindrical body 16*b*, and a swaged lower head 16*c*. The hinge pin 16 has a length, and the cylindrical body 16*b* has a diameter, so as to permit the hinge pin 16 to extend through the aligned holes in the pillar bracket 14 and the door bracket 12, respectively. As such, the enlarged upper head 16*a* rests upon the upper pin bracket peripheral wall 60*a*, the body 16*b* passes through the holes and the swaged lower head 16*c* (which is formed by known riveting or heading techniques on the lower end of the pin body 16*b*), is downwardly adjacent the lower pin bracket peripheral wall 60*b*. As such, the hinge pin 16 is held in place and cannot be removed without destroying the hinge pin 16 and/or one of the hinge brackets 12, 14.

Preferably, and as will be described more fully hereinafter, the hinge pin 16 is held in place so as to be non-rotatably affixed to the pillar hinge bracket 14, while the door hinge bracket 12 is rotatable about the hinge pin 16. Although not illustrated, it is preferred that bushings be received in the holes formed in the upper and lower legs 34, of the U-shaped member 32 of the door hinge bracket 12. The bushings facilitate rotation of the door hinge bracket 12 about the stationary hinge pin 16. It is believed that such bushings are well known to those skilled in the art.

Numerous means for fixing the hinge pin 16 to the pillar hinge bracket 14 are known in the art and can be used interchangeably with the present structure. Such known means include splines, non-circular cross-sectional profiles (i.e., D-shaped cross sections at upper end of the hinge pin body 16*b* and the hole in the upper pin bracket peripheral wall 60*a*), and crimping the hinge pin 16 to the pillar hinge bracket 14.

It is noted that the door hinge bracket 12, pillar hinge bracket 14, and hinge pin 16 described to this point are generally conventional and well known in the art. The various embodiments of the present invention will be described hereinafter as they are used in conjunction with the door hinge bracket 12, pillar hinge bracket 14, and hinge pin 16, modified as described hereinafter.

The first embodiment of the present invention is illustrated in FIGS. 1A-1F, and is described hereinafter.

With reference to FIGS. 1B-1E, the head 16*a* of the hinge pin 16 is shown to include first and second raised tabs or protrusions 68*a*, 68*b* and associated first and second recesses or notches 69*a*, 69*b*. The first and second notches and recesses will hereafter be referred to as the first and second engagement points 70*a*, 70*b*.

Figures 1B, 1C, 1D, 1E, 1F:
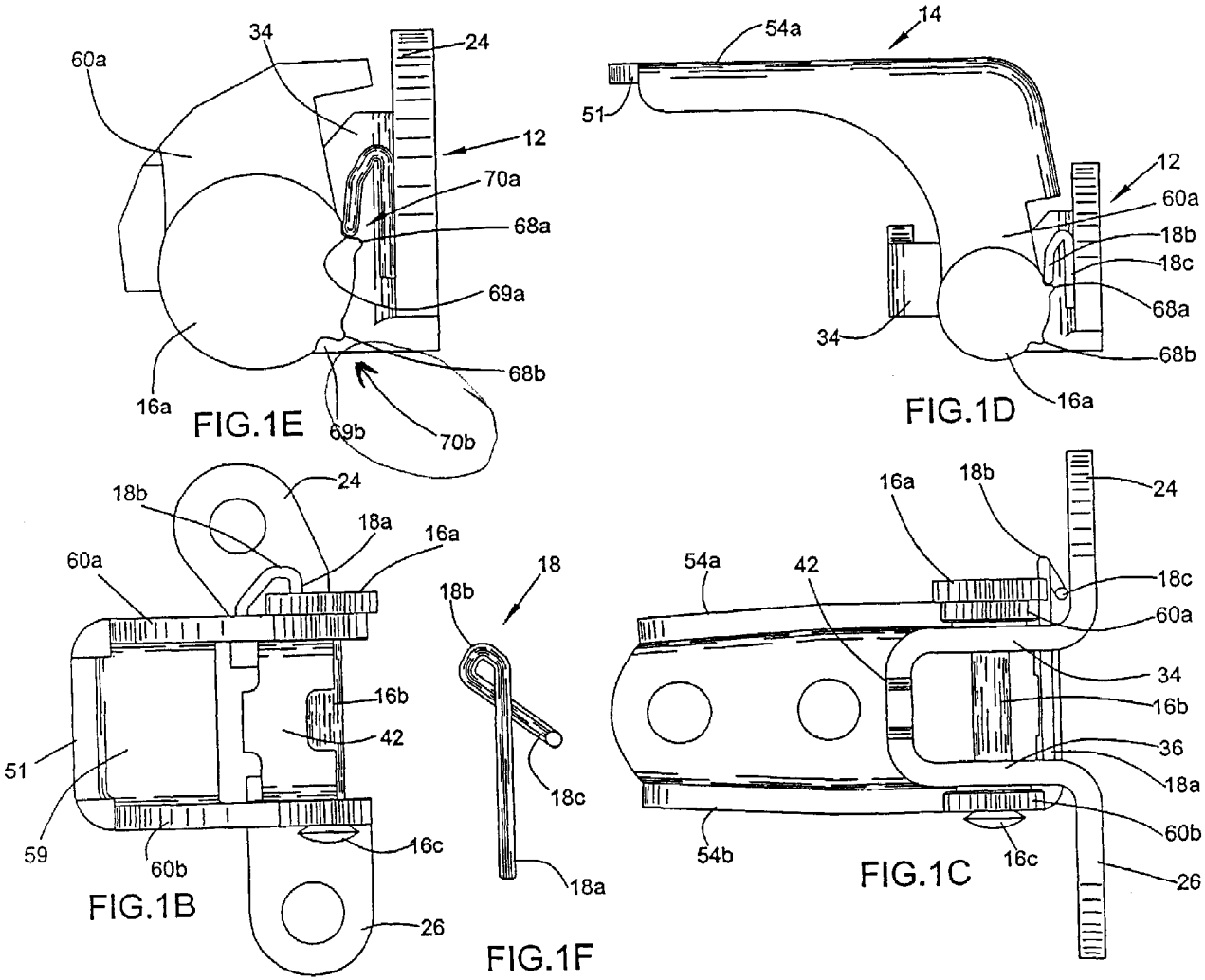
FIG. 1B is a front side elevational view of the hinge system according to the first embodiment.
FIG. 1C is a right side elevational view of the hinge system according to the first embodiment.
FIG. 1D is a top plan view of the hinge system according to the first embodiment.
FIG. 1E is an enlarged plan view of engagement between a latching device and engagement point according to the first embodiment.
FIG. 1F is an elevational view of the latching device according to the first embodiment.

With reference to FIG. 1F, the latching device 18 includes a lower leg 18*a*, an upper bend 18*b* curling around a loop of more than 180 degrees, and an upper arm 18*c*. The lower leg extends through aligned holes formed in the upper and lower legs 34, 36 of the U-shaped member 32 of the door hinge bracket 12. The upper bend 18*b* and the upper arm 18*c* are disposed above the upper leg 34 of the door hinge bracket U-shaped member 32, and adjacent the first or upper ear 24 of the door hinge bracket. It will be appreciated that the latching device 18 is preferably formed from a resilient metal material, such as steel or spring steel, and therefore will inherently exhibit a certain amount of bending or temporary deformation, when appropriate force is applied. The present invention takes advantage of that fact in using the latching device 18 to selectively engage the engagement points 70*a*, 70*b*, which serve as catches to releasably retain the door hinge bracket 12, and the door affixed thereto, releasably retain the door in any one of two angular orientations.

The latching device 18 is installed in the door hinge bracket 12 by simply inserting the latching device leg 18*a* through the aligned holes formed in the upper and lower legs 34, 36 of the door hinge bracket U-shaped member 32. Further, the latching device 18 may be removed after use by simply pulling the latching device 18 out of the door hinge bracket 12.

With the latching device 18 installed in the door hinge bracket 12, and the leg 18*a* in engagement with the first engagement point or catch 70*a* (i.e., received in the first recess 69*a*), the door hinge bracket 12 and the associated door 20 is retained or held in the closed position or first orientation. When a sufficient opening force is applied to the door 20, the upper end of the latching device leg 18*a*, which is in engagement with the first tab or protrusion 68*a*, deforms so as to permit the latching device 18 to clear the first engagement point 70*a*.

Once the latching device 18 is clear of the first engagement point 70*a*, the door hinge bracket 12 continues to rotate (clockwise in FIG. 1D) until the latching device leg 18*a* engages the second tab or protrusion 68*b* provided by the second engagement point or catch 70*b*. With continued application of force, the latching device leg 18*a* again deforms so as to snap over the second tab 68*b* and is received in the second recess 69*b* (second engagement point 70*b*), defining the second orientation (open position) of the door hinge bracket 12 and associated door 20. The door 20 and door hinge bracket 12 will be retained in the second orientation or open position until an appropriate closing force is applied to move the door hinge bracket 12 and latching device 18 toward the closed position, at which the latching device leg 18*a* will again snap over the first engagement point 70*a*.

The second embodiment of the present invention is illustrated in FIGS. 2A-2F, and is described hereinafter.

With reference to FIGS. 2B-2E, the head 16*a* of the hinge pin 16 is shown to include first and second recesses or notches 78*a*, 78*b* and associated first and second radially extending raised tabs or protrusions 79*a*, 79*b*. The first and second notches and recesses will hereafter be referred to as the first and second engagement points 168*a*, 168*b*.

Figures 2B, 2C, 2D, 2E, 2F:
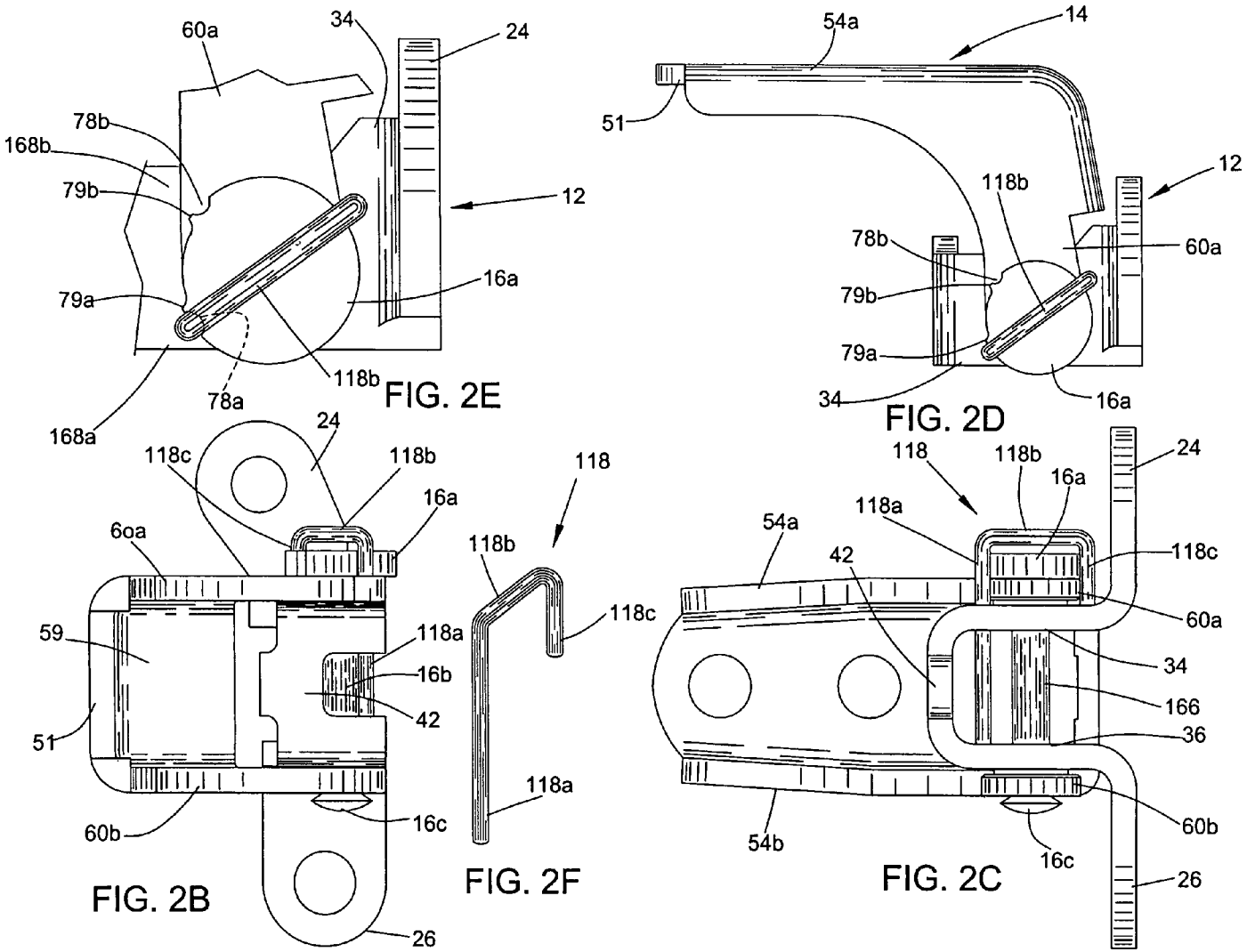
FIG. 2B is a front side elevational view of the hinge system according to the second embodiment.
FIG. 2C is a right side elevational view of the hinge system according to the second embodiment.
FIG. 2D is a top plan view of the hinge system according to the second embodiment.
FIG. 2E is an enlarged plan view of engagement between a latching device and engagement point according to the second embodiment.
FIG. 2F is an elevational view of the latching device according to the second embodiment.
Figure 4A:
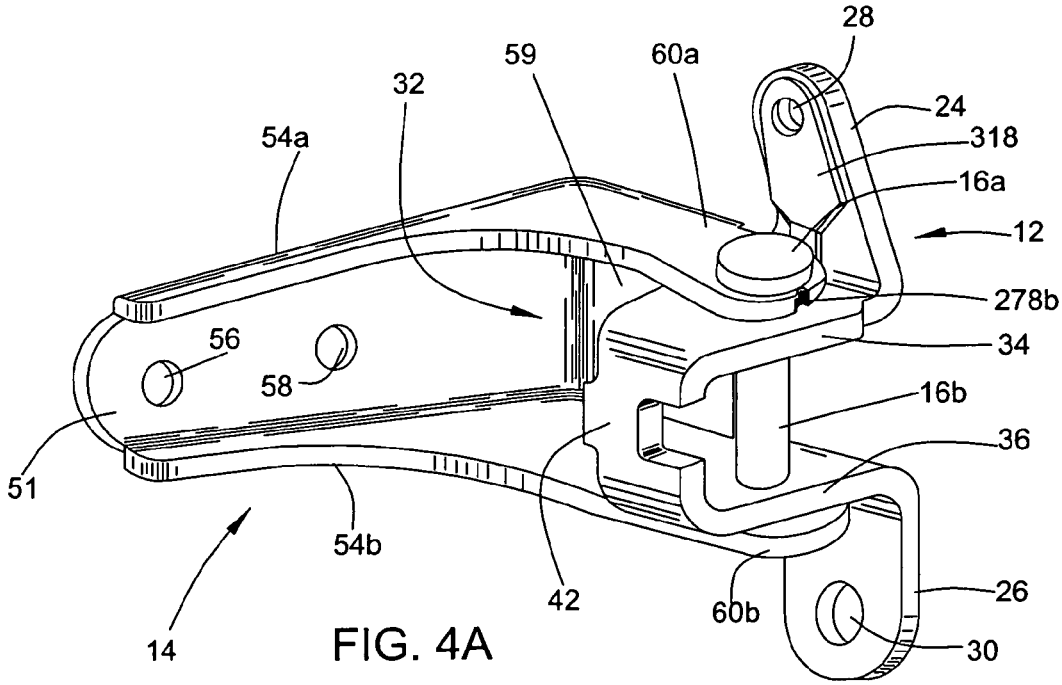
FIG. 4A is a perspective view of a hinge system according to a fourth embodiment of the present invention.

With reference to FIG. 2F, the latching device 118 is somewhat J-shaped, and includes a lower leg 118*a*, an interconnecting portion 118*b*, and an upper arm 118*c*. The lower leg 118*a* extends through aligned holes formed in the upper and lower legs 34, 36 of the U-shaped member 32 of the door hinge bracket 12. It is noted that the aligned holes are formed in the upper and lower legs 34, 36 relatively close to the base 42, as illustrated best in FIG. 2A. The interconnecting portion 118*b* extends diagonally across the upper surface of the hinge pin head 16*a* such that the upper arm 118*c* extends downwardly on the opposite side of the hinge pin head 16*a*, and adjacent to the first or upper ear 24, as shown. It will be appreciated that the latching device 118 is preferably formed from a resilient metal material, such as steel or spring steel, and therefore will inherently exhibit a certain amount of bending or temporary deformation, when appropriate force is applied. The present invention takes advantage of that fact in using the latching device 118 to selectively engage the engagement points 168*a*, 168*b*, which serve as catches to engage the door hinge bracket 12, and the door affixed thereto, so as to releasably retain the door in any one of two angular orientations.

The latching device 118 is installed in the door hinge bracket 12 by simply inserting the latching device leg 118*a* through the aligned holes formed in the upper and lower legs 34, 36 of the door hinge bracket U-shaped member 32. Further, the latching device 118 may be removed after use by simply pulling the latching device 118 out of the door hinge bracket 12.

With the latching device 118 installed in the door hinge bracket 12, and the leg 118*a* in engagement with the first engagement point or catch 168*a* (i.e., received in the first recess 78*a*), the door hinge bracket 12 and the associated door 20 is retained or held in the closed position or first orientation. When a sufficient opening force is applied to the door 20, the upper end of the latching device leg 118*a*, which is adjacent the interconnecting portion 118*b* and in engagement with the first tab or protrusion 79*a*, deforms so as to permit the latching device 118 to clear the first engagement point 168*a*.

Once the latching device 118 is clear of the first engagement point 168*a*, the door hinge bracket 12 continues to rotate (clockwise in FIG. 2D) until the latching device leg 118*a* engages the second tab or protrusion 79*b* provided by the second engagement point or catch 168*b*. With continued application of force, the latching device leg 118*a* again deforms so as to snap over the second tab 79*b* and is received in the second recess 79*b*, defining the second orientation (open position) of the door hinge bracket 12 and associated door 20. The door 20 and door hinge bracket 12 will be retained in the second orientation or open position until an appropriate closing force is applied to move the door hinge bracket 12 and latching device 118 toward the closed position, at which the latching device leg 118*a* will again snap over the first engagement point 168*a*.

The third embodiment of the present invention is illustrated in FIGS. 3A-3F, and is described hereinafter.

With reference to FIGS. 3B-3E, the upper raised peripheral wall 60*a* of the pillar hinge bracket 14 is shown to include first and second recesses or notches 178*a*, 178*b*. The first and second notches and recesses may hereafter be referred to as the first and second engagement points 268*a*, 268*b*.

Figure 3A:
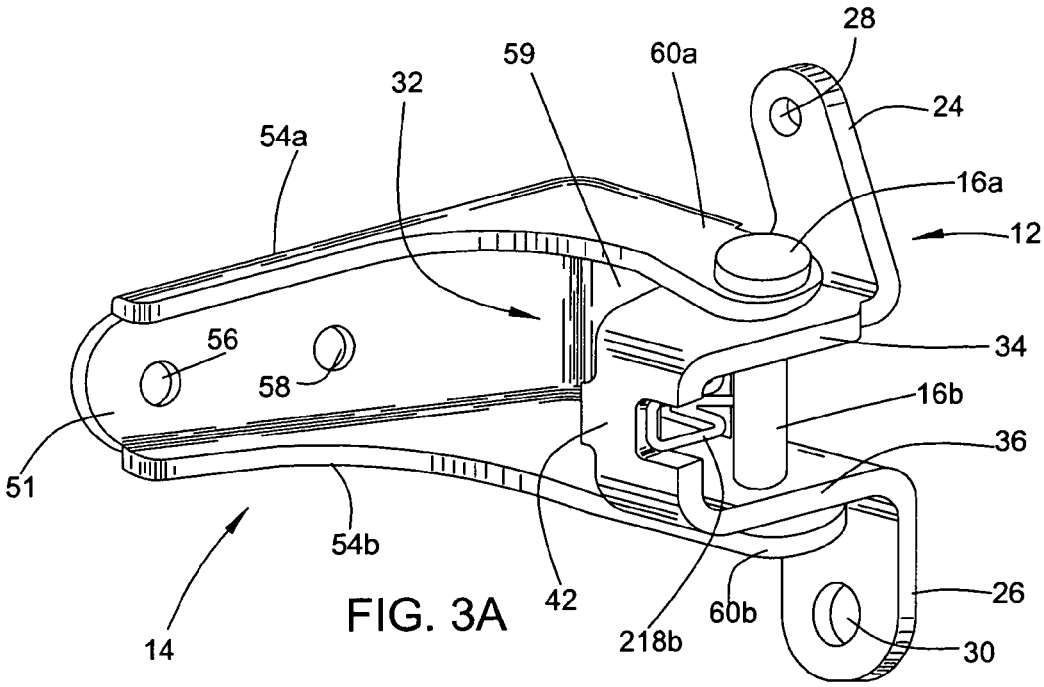
FIG. 3A is a perspective view of a hinge system according to a third embodiment of the present invention.
Figure 3D:
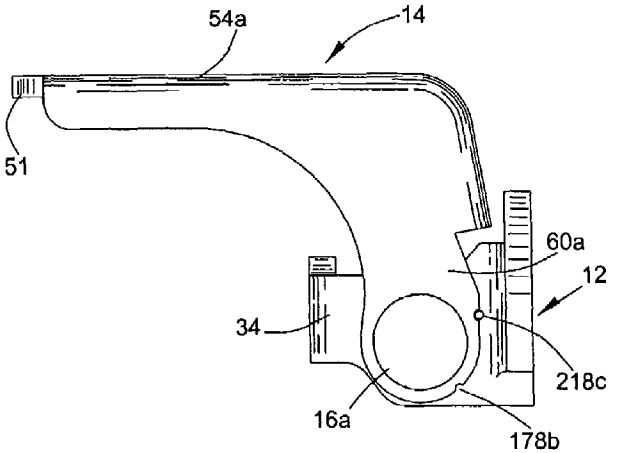
FIG. 3D is a top plan view of the hinge system according to the third embodiment.
Figure 3C:
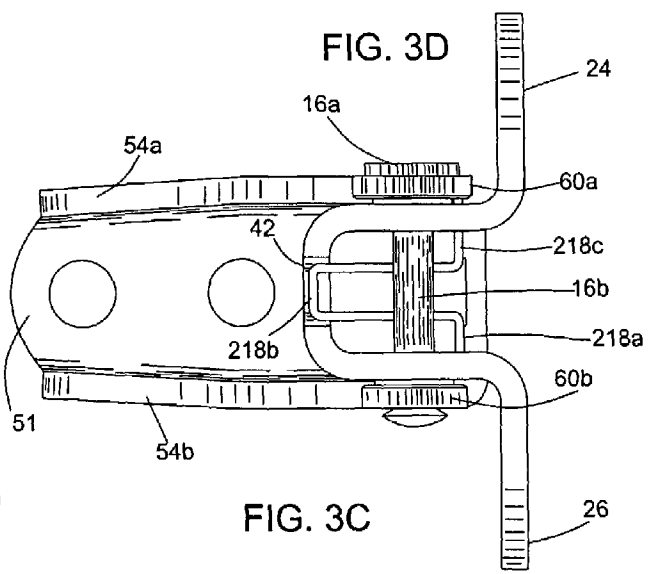
FIG. 3C is a right side elevational view of the hinge system according to the third embodiment.
Figure 3E:
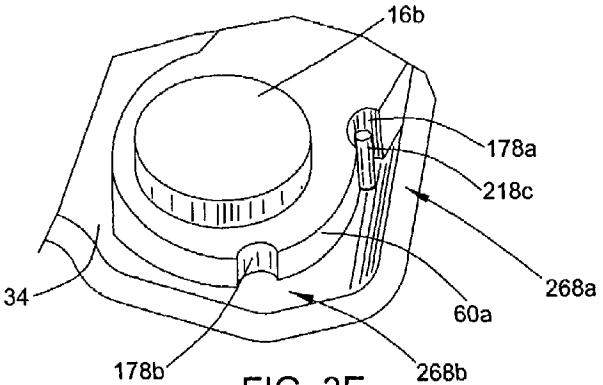
FIG. 3E is an enlarged plan view of engagement between a latching device and engagement point according to the third embodiment.
Figure 3F:
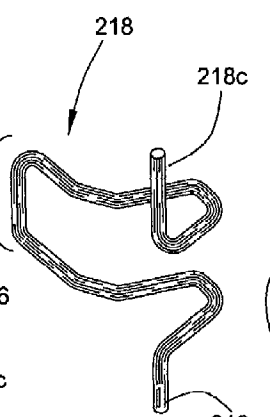
FIG. 3F is an elevational view of the latching device according to the third embodiment.
Figure 3B:
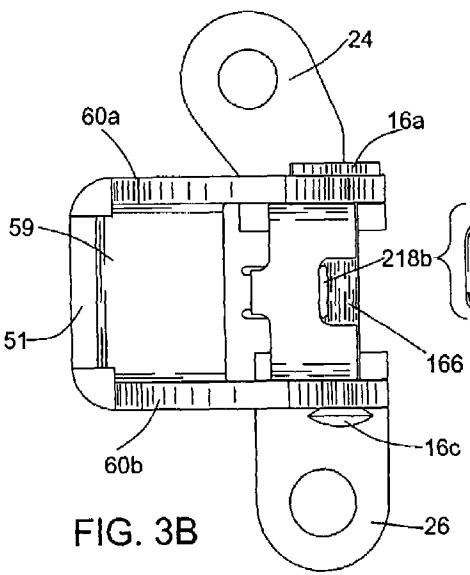
FIG. 3B is a front side elevational view of the hinge system according to the third embodiment.

With reference to FIG. 3F, the latching device 218 includes a lower leg 218*a*, an interconnecting securement portion 218*b*, and an upper leg arm 218*c*. The upper leg 218*c* extends through a hole in the upper leg 34 of the U-shaped member 32 of the door hinge bracket 12. The lower leg 218*a* extends through a hole formed in the lower leg 36 of the U-shaped member of the door hinge bracket 12. The interconnecting securement portion 218*b*, which serves as a spring to force or bias the upper and lower legs 218*c*, 218*a* away from one another, extends across the door hinge bracket 12 and rests against the base 42, as illustrated. It is noted that the holes formed in the upper and lower legs 34, 36 are relatively close to the upper and lower ears 24, 26, as illustrated best in FIG. 3C. It will be appreciated that the latching device 218 is preferably formed from a resilient metal material, such as steel or spring steel, and therefore will inherently exhibit a certain amount of bending or temporary deformation, when appropriate force is applied. The present invention takes advantage of this fact in using the latching device 218 to selectively engage the engagement points 268*a*, 268*b*, which serve as catches to engage the door hinge bracket 12, and the door affixed thereto, so as to releasably retain the door in any one of two angular orientations.

The latching device 218 is installed in the door hinge bracket 12 by simply pinching the interconnecting securement portion 218*b* so as to move the lower and upper legs 218*a*, 218*c* toward one another, inserting the latching device between the upper and lower legs 34, 36 of the door hinge bracket U-shaped member 32, aligning the legs 218*a*, 218*c* with the holes, and releasing the interconnecting securement portion 218*b*. Further, the latching device 218 may be removed after use by simply pinching the interconnecting securement portion 218*b*, and pulling the latching device 218 out of the door hinge bracket 12.

With the latching device 218 installed in the door hinge bracket 12, and the upper leg 218*c* in engagement with the first engagement point or catch 268*a* (i.e., received in the first recess 178*a*), the door hinge bracket 12 and the associated door 20 is retained or held in the closed position or first orientation. When a sufficient opening force is applied to the door 20, the upper latching device leg 218*c* is forced outwardly away from the centerline of the hinge pin and thereby temporarily deforms to allow the latching device 218 to clear the first engagement point 268*a*.

Once the latching device 218 is clear of the first engagement point 268*a*, the door hinge bracket 12 continues to rotate (clockwise in FIG. 3D) until the latching device upper leg 218*c* aligns with the second recess 178*b* defining the second engagement point, at which point the upper leg 218*c* resiliently snaps inwardly into the second recess 178*b*, thereby defining the second orientation (open position) of the door hinge bracket 12 and associated door 20. The door 20 and door hinge bracket 12 will be retained in the second orientation or open position until an appropriate closing force is applied to move the door hinge bracket 12 and latching device 218 toward the closed position, at which the latching device leg 218*c* will again snap into the first engagement point 168*a*.

The fourth embodiment of the present invention is illustrated in FIGS. 4A-4F, and is described hereinafter.

With reference to FIGS. 4B-4E, the upper raised peripheral wall 60*a* of the pillar hinge bracket 14 is shown to include first and second recesses or notches 278*a*, 278*b*. The first and second notches and recesses may hereafter be referred to as the first and second engagement points 368*a*, 368*b*.

Figures 4B, 4C, 4D, 4E, 4F:
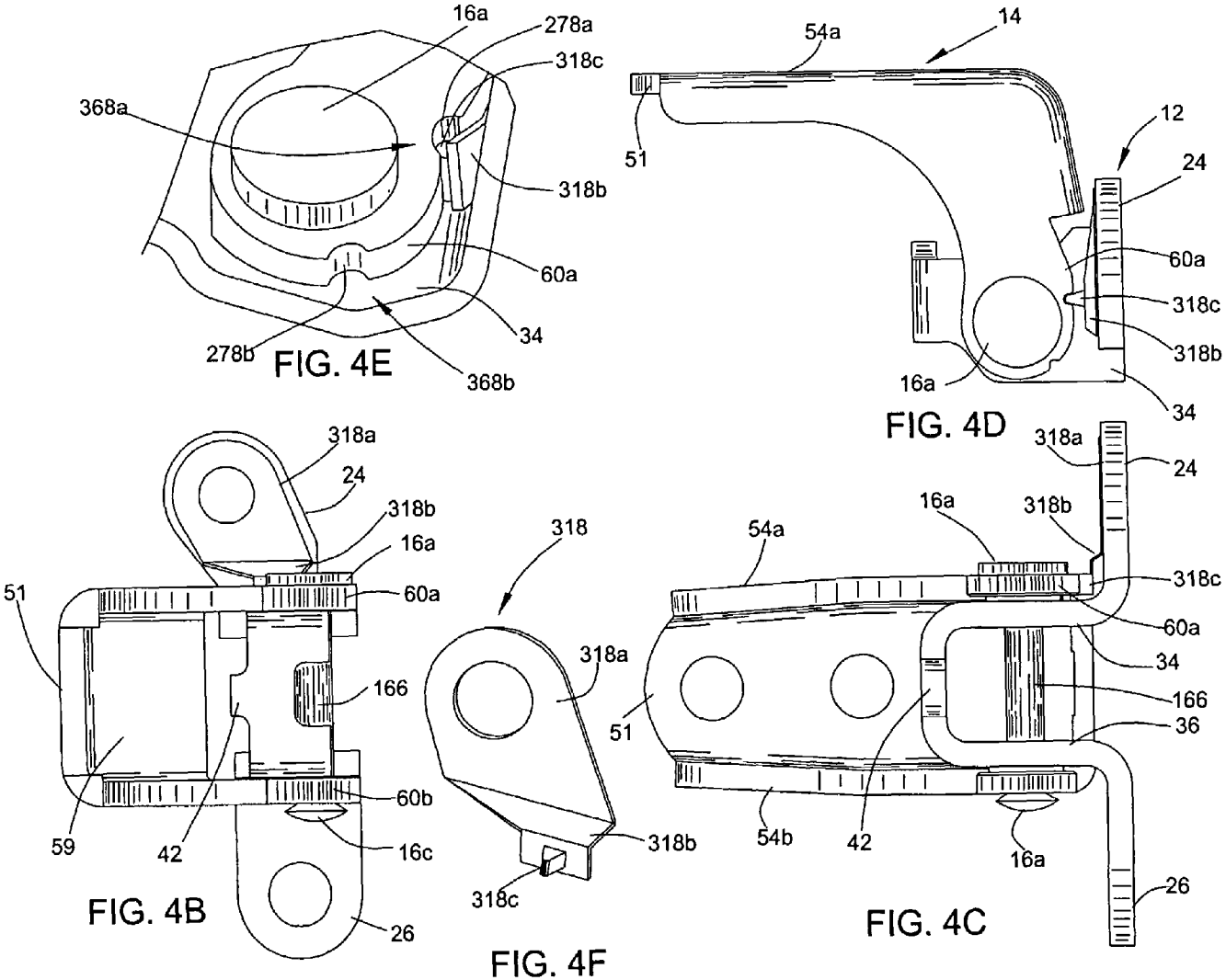
FIG. 4B is a front side elevational view of the hinge system according to the fourth embodiment.
FIG. 4C is a right side elevational view of the hinge system according to the fourth embodiment.
FIG. 4D is a top plan view of the hinge system according to the fourth embodiment.
FIG. 4E is an enlarged plan view of engagement between a latching device and engagement point according to the fourth embodiment.
FIG. 4F is an elevational view of the latching device according to the fourth embodiment.
Figure 6A:
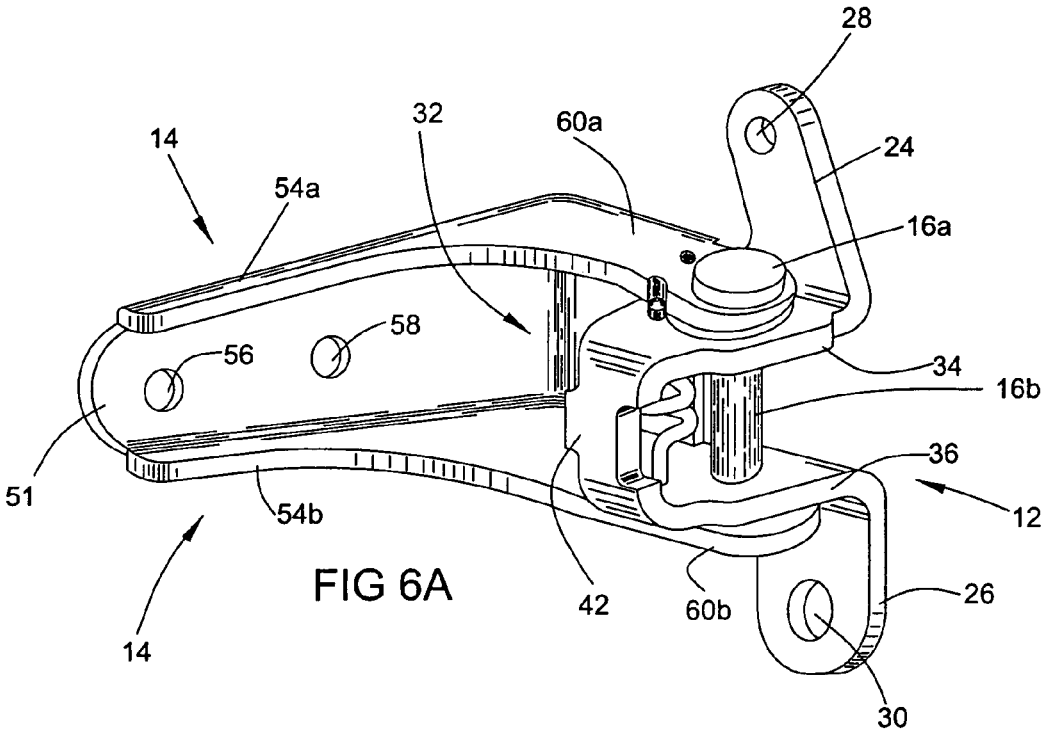
FIG. 6A is a perspective view of a hinge system according to a sixth embodiment of the present invention.

With reference to FIG. 4F, the latching device 318 includes a body portion 318*a*, a depending flange 318*b*, and an extending tab 318*c*. The body portion is secured to the upper ear 24 of the door hinge bracket 12, preferably with the fastener that secures the door hinge bracket 12 to the door 20. The depending flange 318*b* extends from the body portion 318*a* and serves as a spring to bias the extending tab 318*c* into engagement with the engagement points 368*a*, 368*b*. It will be appreciated that the latching device 318 is preferably formed from a resilient metal material, such as steel or spring steel, and therefore will inherently exhibit a certain amount of bending or temporary deformation, when appropriate force is applied. The present invention takes advantage of this fact in using the latching device 318 to selectively engage the engagement points 368*a*, 368*b*, which serve as catches to engage the door hinge bracket 12, and the door affixed thereto, so as to releasably retain the door in any one of two angular orientations.

The latching device 318 is affixed to the door hinge bracket 12 by using the fastener that secures the door hinge bracket 12 to the door 20, and is removed by removing the fastener.

With the latching device 318 installed on the door hinge bracket 12, and the tab 318*c* in engagement with the first engagement point or catch 368*a* (i.e., received in the first recess 278*a*), the door hinge bracket 12 and the associated door 20 is retained or held in the closed position or first orientation. When a sufficient opening force is applied to the door 20, the tab 318*c* is forced against the bias of the flange 318*b*, allowing the latching device 318 to clear the first engagement point 368*a*.

Once the latching device 318 is clear of the first engagement point 368*a*, the door hinge bracket 12 continues to rotate (clockwise in FIG. 4D) until the latching device tab 318*c* aligns with the second recess 278*b* defining the second engagement point 368*b*, at which point the tab 318*c* resiliently snaps inwardly (i.e., toward the hinge pin centerline) into the second recess 278*b*, thereby defining the second orientation (open position) of the door hinge bracket 12 and associated door 20. The door 20 and door hinge bracket 12 will be retained in the second orientation or open position until an appropriate closing force is applied to move the door hinge bracket 12 and latching device 318 toward the closed position, at which the latching device tab 318*c* will again snap into the first engagement point 268*a*.

The fifth embodiment of the present invention is illustrated in FIGS. 5A-5F, and is described hereinafter.

With reference to FIGS. 5B-5E, the upper raised peripheral wall 60*a* of the pillar hinge bracket 14 is shown to include a first notched recess 378*a* and a second recess or hole 378*b*. The first recess is in an edge of the upper peripheral wall 60*a* while the second recess is a hole through the upper peripheral wall 60*a*, as illustrated. The first and second recesses 378*a*, 378*b* may hereafter be referred to as the first and second engagement points 468*a*, 468*b*.

Figure 5A:
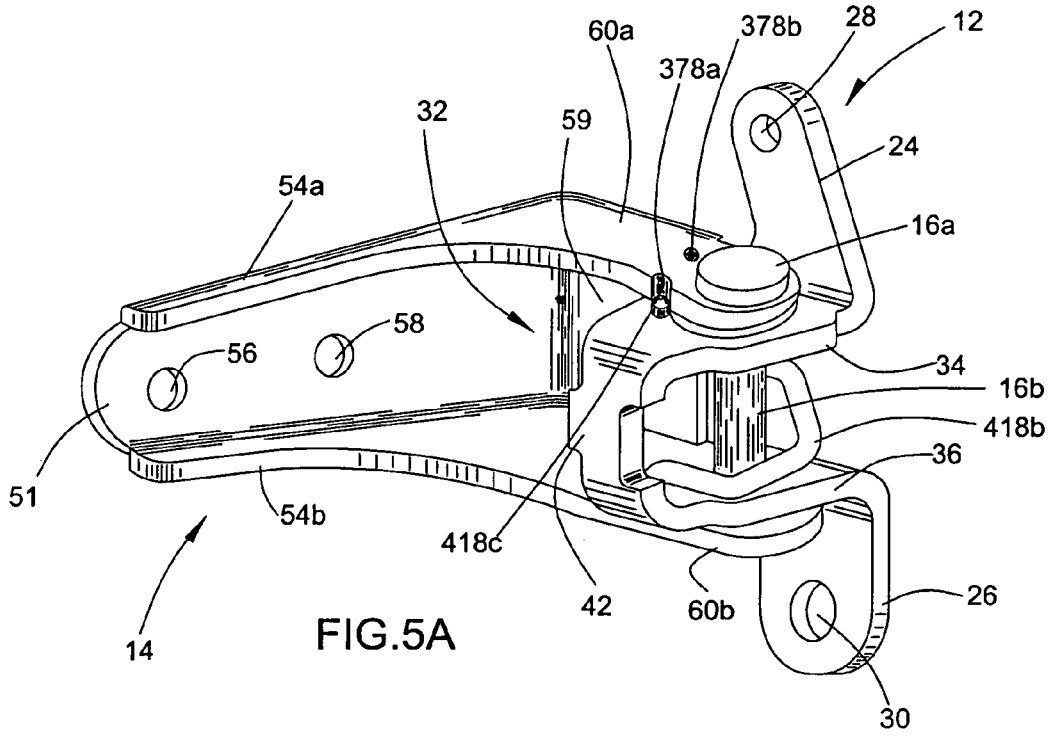
FIG. 5A is a perspective view of a hinge system according to a fifth embodiment of the present invention.
Figures 5B, 5C, 5D, 5E, 5F:
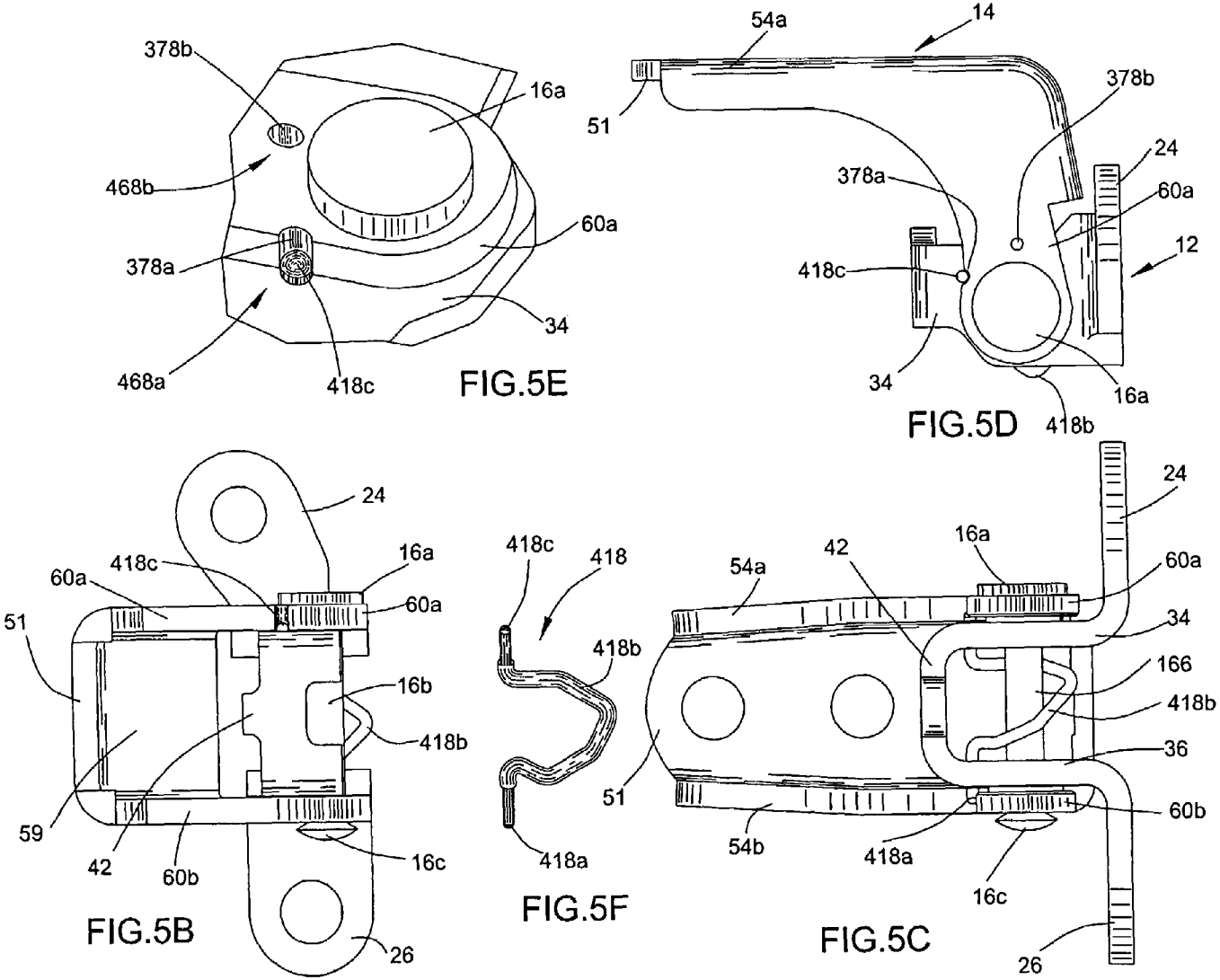
FIG. 5B is a front side elevational view of the hinge system according to the fifth embodiment.
FIG. 5C is a right side elevational view of the hinge system according to the fifth embodiment.
FIG. 5D is a top plan view of the hinge system according to the fifth embodiment.
FIG. 5E is an enlarged plan view of engagement between a latching device and engagement point according to the fifth embodiment.
FIG. 5F is an elevational view of the latching device according to the fifth embodiment.

With reference to FIG. 5F, the latching device 418 includes a lower leg 418*a*, an interconnecting spring portion 418*b*, and an upper leg 418*c*. The upper leg 418*c* extends through a hole in the upper leg 34 of the U-shaped member 32 of the door hinge bracket 12. The lower leg 418*a* extends through a hole formed in the lower leg 36 of the U-shaped member 32 of the door hinge bracket 12. The interconnecting spring portion 418*b*, which serves to force or bias the upper and lower legs 418*c*, 418*a* away from one another, extends around the hinge pin 16, as illustrated. It is noted that the holes formed in the upper and lower legs 34, 36 are relatively close to the base 42 of the U-shaped portion 32, as illustrated best in FIG. 5C. It will be appreciated that the latching device 418 is preferably formed from a resilient metal material, such as steel or spring steel, and therefore will inherently exhibit a certain amount of bending or temporary deformation, when appropriate force is applied. The present invention takes advantage of this fact in using the latching device 418 to selectively engage the engagement points 468*a*, 468*b*, which serve as catches to engage the door hinge bracket 12, and the door affixed thereto, so as to releasably retain the door in any one of two angular orientations.

The latching device 418 is installed in the door hinge bracket 12 by simply pinching the interconnecting spring portion 418*b* so as to move the lower and upper legs 418*a*, 418*c* toward one another, inserting the latching device between the upper and lower legs 34, 36 of the door hinge bracket U-shaped member 32, aligning the legs 418*a*, 418*c* with the holes, and releasing the interconnecting spring portion 418*b*. The upper leg 418*c* will project upwardly from the door hinge upper leg 34, as shown in FIG. 5E. Further, the latching device 418 may be removed after use by simply pinching the spring portion 418*b*, and pulling the latching device 418 out of the door hinge bracket 12.

With the latching device 418 installed in the door hinge bracket 12, and the upper leg 418*c* in engagement with the first engagement point or catch 468*a* (i.e., received in the first recess 378*a*), the door hinge bracket 12 and the associated door 20 is retained or held in the closed position or first orientation. When a sufficient opening force is applied to the door 20, the latching device upper leg 418*c* is forced downwardly against the bias of the spring portion 418*b*, allowing the latching device 418 to clear the first engagement point 468*a*.

Once the latching device 418 is clear of the first engagement point 468*a*, the door hinge bracket 12 continues to rotate (clockwise in FIG. 5D) and the upper leg 418*c* slides along the lower surface of the upper peripheral wall 60*a* until the latching device upper leg 418*c* aligns with the second recess 378*b* defining the second engagement point 468*b*, at which point the upper leg 418*c* resiliently snaps upwardly into the second recess 378*b*, thereby defining the second orientation (open position) of the door hinge bracket 12 and associated door 20. The door 20 and door hinge bracket 12 will be retained in the second orientation or open position until an appropriate closing force is applied to move the door hinge bracket 12 and latching device 418 toward the closed position, at which the latching device leg 418*c* will again snap into the first engagement point 468*a*.

The sixth embodiment of the present invention is illustrated in FIGS. 6A-6F, and is described hereinafter.

With reference to FIGS. 6B-6E, the upper raised peripheral wall 60*a* of the pillar hinge bracket 14 is shown to include a first notched recess 378*a* and a second recess or hole 378*b*. The first recess is in an edge of the upper peripheral wall 60*a* while the second recess is a hole through the upper peripheral wall 60*a*, as illustrated. The first and second recesses 378*a*, 378*b* may hereafter be referred to as the first and second engagement points 468*a*, 468*b*.

Figure 6D:
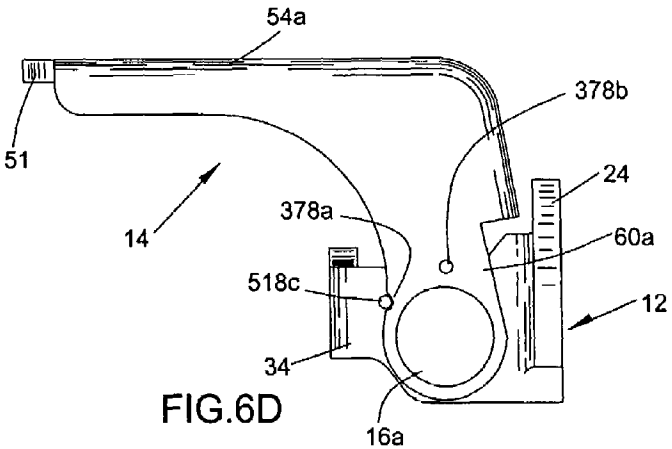
FIG. 6D is a top plan view of the hinge system according to the sixth embodiment.
Figure 6C:
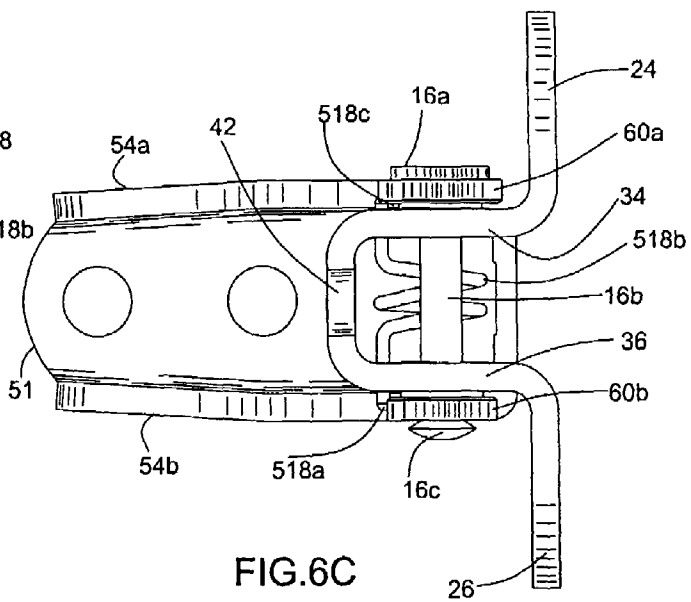
FIG. 6C is a right side elevational view of the hinge system according to the sixth embodiment.
Figure 6E:
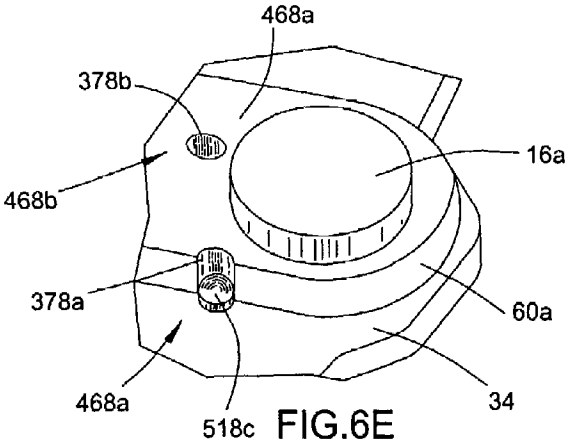
FIG. 6E is an enlarged plan view of engagement between a latching device and engagement point according to the sixth embodiment; and, FIG. 6F is an elevational view of the latching device according to the sixth embodiment.
Figure 6F:
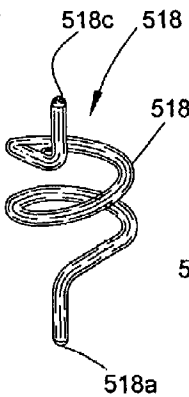
FIG. 6B is a front side elevational view of the hinge system according to the sixth embodiment.
Figure 6B:
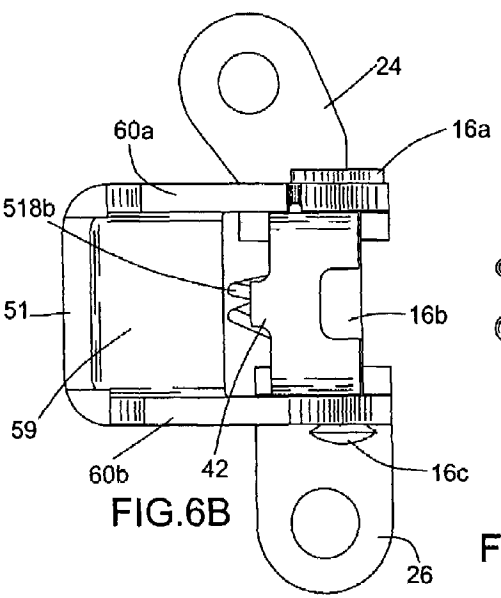
Figure 1E:
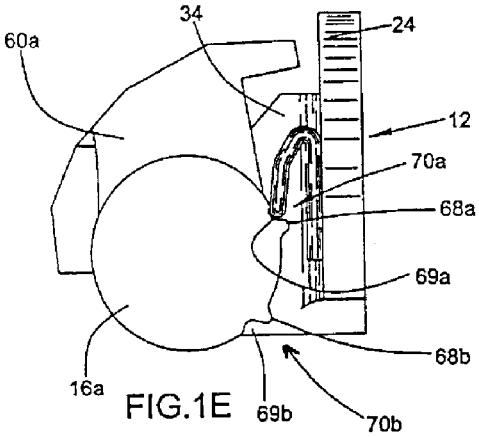
Figure 1D:
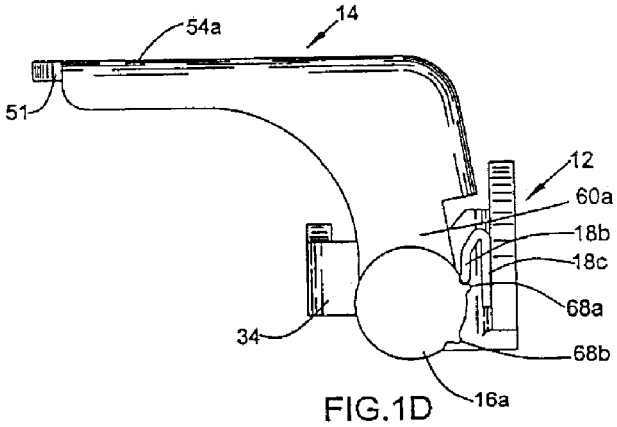
Figure 1B:
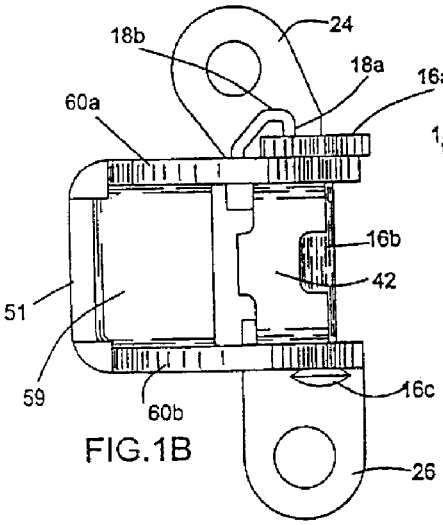
Figure 1F:
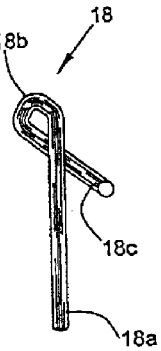
Figure 1C:
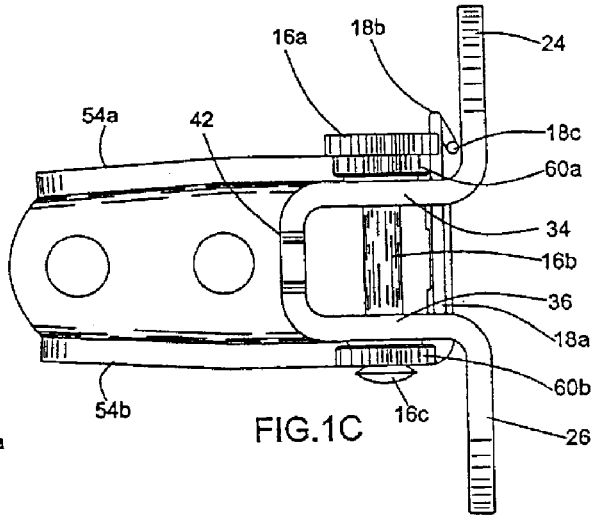

With reference to FIG. 6F, the latching device 518 includes a lower leg 518*a*, an interconnecting coil spring portion 518*b*, and an upper leg 518*c*. The upper leg 518*c* extends through a hole in the upper leg 34 of the U-shaped member 32 of the door hinge bracket 12. The lower leg 518*a* extends through a hole formed in the lower leg 36 of the U-shaped member 32 of the door hinge bracket 12. The interconnecting coil spring portion 518*b*, which serves to force or bias the upper and lower legs 518*c*, 518*a* away from one another, extends adjacent to the hinge pin 16, as illustrated. It is noted that the holes formed in the upper and lower legs 34, 36 are relatively close to the base 42 of the U-shaped portion 32, as illustrated best in FIG. 6C. It will be appreciated that the latching device 518 is preferably formed from a resilient metal material, such as steel or spring steel, and therefore will inherently exhibit a certain amount of bending or temporary deformation, when appropriate force is applied. The present invention takes advantage of this fact in using the latching device 518 to selectively engage the engagement points 468*a*, 468*b*, which serve as catches to engage the door hinge bracket 12, and the door affixed thereto, so as to releasably retain the door in any one of two angular orientations.

The latching device 518 is installed in the door hinge bracket 12 by simply pinching the interconnecting coil spring portion 518*b* so as to move the lower and upper legs 518*a*, 518*c* toward one another, inserting the latching device between the upper and lower legs 34, 36 of the door hinge bracket U-shaped member 32, aligning the legs 518*a*, 518*c* with the holes, and releasing the interconnecting coil spring portion 518*b*. The upper leg 518*c* will project upwardly from the door hinge upper leg 34, as shown in FIG. 6E. Further, the latching device 518 may be removed after use by simply pinching the coil spring portion 518*b*, and pulling the latching device 518 out of the door hinge bracket 12.

With the latching device 518 installed in the door hinge bracket 12, and the upper leg 518*c* in engagement with the first engagement point or catch 468*a* (i.e., received in the first recess 378*a*), the door hinge bracket 12 and the associated door 20 is retained or held in the closed position or first orientation. When a sufficient opening force is applied to the door 20, the latching device upper leg 518*c* is forced downwardly against the bias of the coil spring portion 518*b*, allowing the latching device 518 to clear the first engagement point 468*a*.

Once the latching device 518 is clear of the first engagement point 468*a*, the door hinge bracket 12 continues to rotate (clockwise in FIG. 6D) and the upper leg 518*c* slides along the lower surface of the upper peripheral wall 60*a* until the latching device upper leg 518*c* aligns with the second recess 378*b* defining the second engagement point 468*b*, at which point the upper leg 518*c* resiliently snaps upwardly into the second recess 378*b*, thereby defining the second orientation (open position) of the door hinge bracket 12 and associated door 20. The door 20 and door hinge bracket 12 will be retained in the second orientation or open position until an appropriate closing force is applied to move the door hinge bracket 12 and latching device 518 toward the closed position, at which the latching device leg 518*c* will again snap into the first engagement point 468*a*.

The latching devices described herein may be formed from any number of materials. Preferably, the latching device 18 is formed from a metal material (i.e., steel, spring steel) that will provide the desired spring-like effect. Similar effects can be achieved should the latching device 18 be formed from plastic, or a combination of steel and plastic. It is currently believed that a metal material will be preferred for reasons of cost, durability, and ease of manufacture.

The latching devices described herein work efficiently as part of a hinge system 10 upon a vehicle. The hinge system is manufactured with both the door hinge bracket 12 and pillar hinge bracket 14 receiving the hinge pin 16. As noted hereinbefore, there is no relative motion between the pillar hinge bracket 14 and the hinge pin 16. Rather, the door hinge bracket 12 is free to move with respect to the hinge pin 16 and the pillar hinge bracket 14.

This hinge system 10 is adapted for use during intermediate vehicle assembly and especially during a painting operation wherein the doors 48 or door hinge brackets 12 must be moved between a first position or angular orientation relative to the vehicle body and a second position or angular orientation relative to the vehicle body, as described hereinbefore.

It is further believed that the first and second orientations may be different than the open and closed positions illustrated, and that intermediate angular positions in which the door may be retained may easily be added by introducing further engagement points between the two engagement points illustrated in the drawings. It is further noted that the open position and closed positions are relative terms, and while the closed position will ordinarily be a fully closed position, the open position may be an angular orientation short of the 'full open' position.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents.

What is claimed is:

1. A hinge system that is adapted to releasably retain a vehicle door in a desired angular orientation on a vehicle body, comprising:

a pillar hinge bracket adapted to be secured to the vehicle body;

a door hinge bracket adapted to be secured to the vehicle door, said door hinge bracket being movable between a first angular orientation relative to said pillar hinge bracket and a second angular orientation relative to said pillar hinge bracket;

a hinge pin having a generally circular head, said hinge pin extending through the pillar hinge bracket and the door hinge bracket and relative to which the door hinge bracket is rotatable;

at least first and second engagement points provided on the generally circular head of said hinge pin, wherein between the engagement points, the perimeter of the head of the hinge pin has a consistent radius that is generally equivalent to the radius of the remainder of the perimeter of the head; and, a latching device including a first straight portion, a second straight portion transverse to the first straight portion, and an intermediate portion located therebetween that curls around a loop of more than 180 degrees, said latching device first straight portion being releasably affixed to said door hinge bracket and being releasably engageable with any of said at least first and second engagement points so as to releasably retain said door hinge bracket, and said vehicle door secured thereto, in said first and second angular orientations and said second straight portion abutting the door bracket.

2. The hinge system according to claim 1, wherein said door hinge bracket includes an upper ear and a lower ear that are adapted to be secured to the vehicle door, and wherein said latching device is releasably secured to at least one of said upper and lower ears.

3. A hinge system that is adapted to releasably retain a vehicle door in a desired angular orientation on a vehicle body, comprising:

a pillar hinge bracket adapted to be secured to the vehicle body;

a door hinge bracket adapted to be secured to the vehicle door, said door hinge bracket being movable between a first angular orientation relative to said pillar hinge bracket and a second angular orientation relative to said pillar hinge bracket;

a hinge pin extending through the pillar hinge bracket and the door hinge bracket and relative to which the door hinge bracket is rotatable;

at least first and second engagement points provided on a head of said hinge pin; and, a latching device comprising a straight portion that terminates one end of the latching device, said latching device being releasably affixed to said door hinge bracket and being releasably engageable with any of said at least first and second engagement points so as to releasably retain said door hinge bracket, and said vehicle door secured thereto, in said first and second angular orientations; and wherein said door hinge bracket includes first and second mounting ears and a U-shaped intermediate member extending between and interconnecting the first and second mounting ears, wherein the U-shaped intermediate member includes an upper leg and a lower leg and a base extending between a first end of the upper leg and a first end of the lower leg and wherein the first mounting ear projects from a second end of the upper leg and the second mounting ear projects from a second end of the lower leg, wherein the straight portion of the latching device is received within apertures in both said upper and said lower legs and projects from at least one of the upper and lower legs, and said hinge pin extends through openings in said upper and lower legs, and wherein said latching device is releasably secured to at least one of said upper and lower legs and projects from said at least one upper and lower legs.

4. The hinge system of claim 3, wherein the latching device further comprises a second straight portion parallel to the first straight portion and an intermediate portion between and transverse to the first and second straight portions.

5. A method of using a door hinge assembly to selectively releasably retain a door in any one of a plurality of positions relative to a vehicle body, wherein said door hinge assembly includes a pillar hinge bracket, a door hinge bracket that includes first and second mounting ears and a U-shaped intermediate member extending between and interconnecting the first and second mounting ears, a hinge pin affixed to said pillar hinge bracket and about which said door hinge bracket rotates, and a latching device including a first straight latching portion and a second straight portion transverse to the first straight portion and an intermediate portion located therebetween that curls around a loop of more than 180 degrees, wherein one of the hinge pin and the pillar hinge bracket defines at least two engagement points that are adapted to selectively receive said latching portion, comprising the steps of:

engaging said latching portion with a first of said at least two engagement points so as to releasably retain said door and said door hinge bracket in a first angular orientation relative to said vehicle body;

applying a force to said door and thereby causing said latching portion to move away from said first of said at least two engagement points and toward a second of said at least two engagement points while rotating said door hinge bracket about said hinge pin, wherein the engagement points are provided on a head of said hinge pin and said latching portion slidably rides over an exterior surface of said hinge pin head as said door is rotated from said first angular orientation toward a second angular orientation; and, continuing to apply force to said door and thereby causing said latching portion to engage said second of said at least two engagement points and thereby releasably retain said door and said door hinge bracket in said second angular orientation relative to said vehicle.

6. The method according to claim 5, wherein said first angular orientation is a closed position of said door and said second angular orientation is an open position of said door.

7. The method according to claim 6, wherein said engagement points are each a recess and said latching portion is receivable in one of said recesses.

8. The method according to claim 6, wherein said latching device includes a biasing engagement portion that urges said latching portion into engagement with said hinge pin head.

9. The method according to claim 8, wherein said latching device is releasably affixed to said door hinge bracket.

10. The method according to claim 5, wherein said engagement points are each a recess and said latching portion is receivable in one of said recesses.

11. The method according to claim 5, wherein said latching device includes a biasing engagement portion that urges said latching portion into engagement with said hinge pin head.

12. The method according to claim 11, wherein said latching device is releasably affixed to said door hinge bracket.

13. A method of assembling a hinge assembly comprising a door hinge bracket, a pillar hinge bracket, a hinge pin, and a latching device, comprising the steps of:

aligning openings in said door hinge bracket, said pillar hinge bracket;

inserting said hinge pin through said aligned openings;

securing said hinge pin to said pillar hinge bracket such that said hinge pin and pillar hinge bracket are immovably affixed to one another;

securing said hinge pin to said door hinge bracket such that said door hinge bracket is rotatable about said hinge pin;

securing said latching device to said door hinge bracket such that said latching device moves with said door hinge bracket, said latching device including a first straight portion that is received within apertures in the door hinge bracket and which terminates one end of the latching device, the latching portion also being in sliding engagement with an exterior surface of said hinge pin;

wherein said door hinge bracket includes first and second mounting ears and a U-shaped intermediate member extending between and interconnecting the first and second mounting ears, and, wherein said hinge pin includes at least two engagement points and said latching portion is selectively received by a first of said at least two engagement points when said door hinge bracket is in a first angular orientation relative to said pillar hinge bracket and is received by a second of said at least two engagement points when said door hinge bracket is in a second angular orientation relative to said pillar hinge bracket.

* * * * *

UNITED STATES PATENT AND TRADEMARK OFFICE

CERTIFICATE OF CORRECTION

PATENT NO. : 7,469,446 B1
APPLICATION NO. : 10/878897
DATED : December 30, 2008
INVENTOR(S) : Brown et al.

It is certified that error appears in the above-identified patent and that said Letters Patent is hereby corrected as shown below:

In the drawings, sheet 2 of 9, please replace the drawing sheet with the attached sheet.

Signed and Sealed this

Twenty-first Day of April, 2009

John Doll

JOHN DOLL
*Acting Director of the United States Patent and Trademark Office*